United States Patent [19]

Hardy

[11] Patent Number: 4,976,359

[45] Date of Patent: Dec. 11, 1990

[54] ROTATABLE ARTICULATED MERCHANDISE DISPLAY UNIT

[75] Inventor: Stephen N. Hardy, Copley, Ohio

[73] Assignee: American Greetings Corporation, Cleveland, Ohio

[21] Appl. No.: 269,233

[22] Filed: Nov. 9, 1988

[51] Int. Cl.[5] ..... B42F 7/00

[52] U.S. Cl. ..... 211/58; 211/163; 211/131

[58] Field of Search ..... 211/58, 163, 94, 162, 211/207, 169, 131

[56] References Cited

U.S. PATENT DOCUMENTS

| | | | |
|---|---|---|---|
| 1,432,286 | 10/1922 | Goldberg | 211/58 |
| 3,223,247 | 12/1965 | Bleed | 211/58 X |
| 3,314,551 | 4/1967 | Plastow | 211/199 |
| 4,079,841 | 3/1978 | Castel | 211/163 X |
| 4,247,010 | 1/1981 | Eckert | 211/163 X |
| 4,339,164 | 7/1982 | Spevak | 211/169 X |
| 4,586,619 | 5/1986 | Eckert | 211/169 X |

*Primary Examiner*—Blair M. Johnson

*Attorney, Agent, or Firm*—Baldwin, Egan & Fetzer

[57] ABSTRACT

A rotatable merchandise display unit comprising a base with a support projecting generally vertically upwardly from the base, and supporting a vertically elongated column-like structure is rotatable relation thereon, with the column being formed of hinged sides and having a plurality of generally vertical rows of merchandise receiving trays disposed along the plural sides of the column, in laterally spaced relation with respect to one another. Each tray of such rows of trays provides upwardly opening pockets for receiving therein merchandise for display. Cams on the inner surfaces of the column sides coact with the central support and provide for the pivotal movement of the column sides relative to one another and thus the pivotal movement or undulation of the merchandise receiving trays with respect to one another during rotation of the column about the central support. The merchandise receiving trays forming the rows thereof are detachably coupled to the column in vertically stacked relationship, by wing structure on the trays coacting with track structure on the respective column side.

14 Claims, 4 Drawing Sheets

42
42b
42a
22
19
32
32b
24
32a
40

19
24
32
32b
40

38a
38c'
38
38b
38c 38a
38b
38c
38c'
38
46
38c 38a
46
38
38b
38c 38a
46
38c
38c'
38b
38
38c

ROTATABLE ARTICULATED MERCHANDISE DISPLAY UNIT

The present invention relates to a rotatable merchandise display unit for displaying various types of merchandise, such as for instance greeting cards and the like, and more particularly relates to a rotatable display unit having a plurality of generally vertical rows of radially extending merchandise receiving pockets or structures, disposed in generally lateral relationship with respect to one another around an articulated column structure rotatable with respect to a central support wherein the column structure and mounted row of merchandise receiving pockets are adapted to undulate or pivot with respect to one another during rotation of the column and pockets about the central support.

BACKGROUND OF THE INVENTION

Many types of article display units or merchandise fixtures are well known in the prior art, and many types of rotatable display units, conventionally called or referred to as "spinner type" display units, are known. Spinner type display units generally consist of a rotatable column or columns, on which are mounted merchandise display shelves or trays, with the shelves or trays having upwardly facing pockets for receiving and displaying merchandise therein, such as for instance greeting cards, or other types of merchandise. These shelves or trays do not usually move relative to one another during rotation of the display unit about its vertical axis.

SUMMARY OF THE INVENTION

The present invention provides a rotatable merchandise display unit of the aforementioned "spinner type" but wherein the merchandise receiving trays or shelves can undulate, or pivot, relative to one another during rotation of the shelves about the central support of the display unit, thereby providing for better viewing of the merchandise disposed in the pockets of trays, but also presenting unique attention-getting motion during rotation of the display unit.

Accordingly it is an object of the present invention to provide a novel rotatable type merchandise display unit or fixture.

Another object of the invention is to provide a merchandise display unit of the aforementioned type which comprises a generally central support projecting upwardly from a base and supporting vertically elongated articulated column structure in rotatable relation thereon and with a plurality of generally vertically oriented rows of merchandise receiving pockets or trays disposed along the column, with cam means on the inner sides of the column coacting with the central support, and providing for the rows of merchandise receiving pockets to undulate or pivot with respect to one another during rotation of the column structure and mounted merchandise receiving trays, about the central support.

Another object of the invention is to provide a merchandise display unit of the aforementioned type, wherein the column structure is of polygonal configuration in plan, with the sides of the polygonal configuration being hinged to one another for relative pivotal movement therebetween during rotation of the column structure about the central support, thus resulting in the specified undulating or pivotal movement of the merchandise receiving pockets or trays of the display unit with respect to one another, during said rotation.

A still further object of the invention is to provide a merchandise display unit of the afore-mentioned type wherein the rows of merchandise receiving pockets or trays consist of members disposed in generally stacked relationship and which are removably coupled to the articulated column by coacting track and wing means.

A still further object of the invention is to provide a merchandise display unit of the aforementioned type wherein the merchandise receiving trays are formed of translucent or transparent plastic so that the merchandise in each tray pocket is visible through the retaining sidewalls thereof.

A still further object of the invention is to provide a merchandise display unit of the aforementioned type wherein the rotatable column of the unit is formed of vertically elongated webs hinged to one another to form a column structure having in plan a generally hexagonal configuration, in one reposed condition of the column.

DESCRIPTION OF PREFERRED EMBODIMENT

Figure 1:
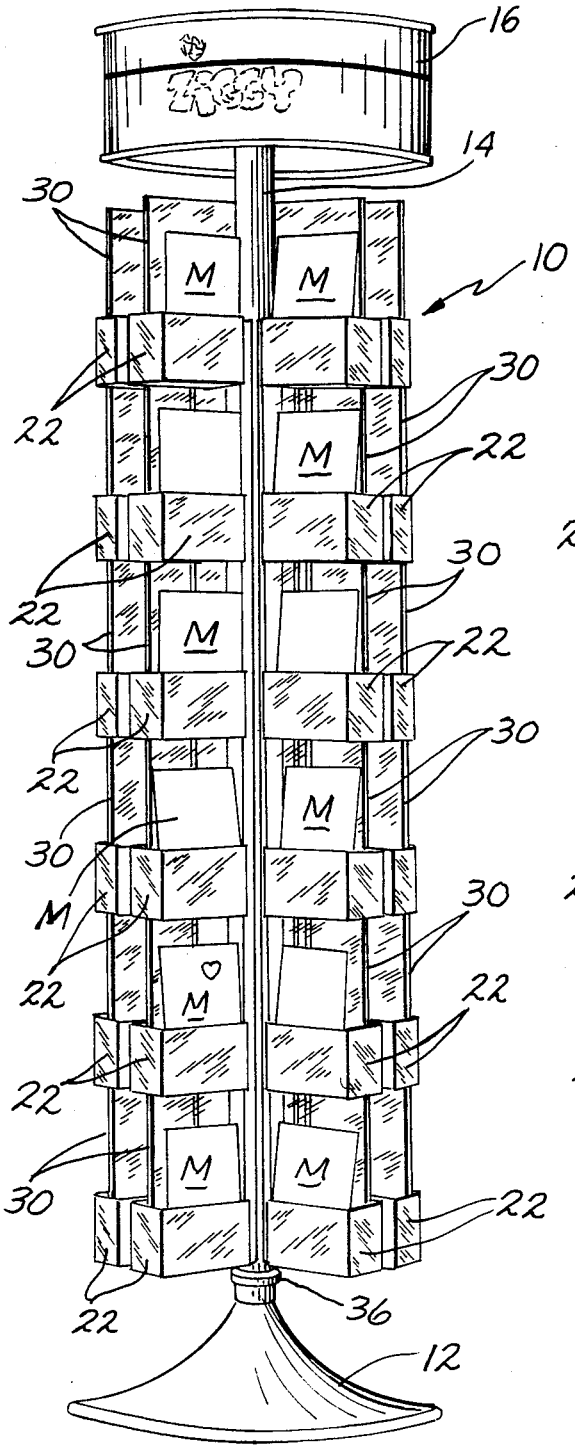
FIG. 1 is a generally perspective, elevational view of a merchandise display unit or "spinner" embodying the invention.
Figure 2:
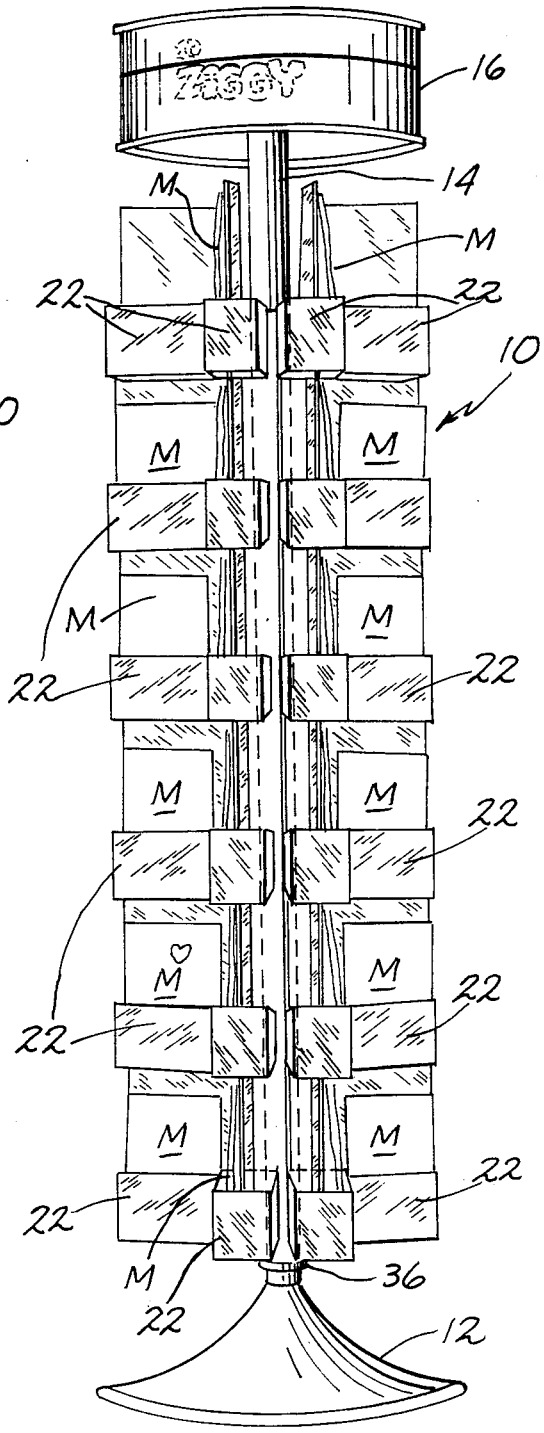
FIG. 2 is a generally perspective view of the merchandise display unit of FIG. 1 taken from another elevational angle thereof.

Referring now again to the drawings and particularly to FIGS. 1 and 2 thereof, there is illustrated a "spinner type" portable, merchandise display unit 10 embodying the invention, and comprising in the embodiment illustrated, a base 12 having a generally vertical, central support or post 14 extending upwardly therefrom, with a header structure 16 mounted on the upper end of the central support 14 and adapted to have advertising indicia shown thereon, promoting the merchandise M displayed by unit 10.

Rotatably mounted on and supported by the central support 14 is an elongated column 18 (FIG. 3) which comprises a polygonal shaped structure in plan (FIGS. 4 and 5) including side members 19 which are hinged or coupled to one another at their adjacent edges, so that the side members 19 can pivot or hingedly move relative to one another during rotation of the column structure 18 about the central support 14.

Merchandise receiving trays 22 are mounted on a respective side member 19 of the column, and in the embodiment illustrated are removably mounted, so as to project generally radially outwardly from the respective side member 19 and thus move or undulate relative to one another during the hinged movement of the side members of the column, relative to one another upon rotation of the column about support 14.

Each of the side members 19 in the embodiment illustrated, has inwardly projecting flanges representing track structure 24 on its outer face, adjacent its side edges, and each tray 22 preferably has wing structure 26 (FIGS. 4 and 5) at its inner end, which is received in the track structure 24 of the respective side member, so as to slidably mount the respective merchandise receiving tray 22 on its respective side member, and as aforementioned in radially projecting relation to the respective side member.

Each of the merchandise receiving trays 22 comprises, in the embodiment illustrated, a receptacle 28 (FIG. 3) having a generally central web 30 projecting upwardly therefrom and dividing the receptacle into lateral merchandise receiving sections 28*a*, 28*b*, which are adapted to receive therein merchandise, such as for instance, greeting cards.

Figure 3:
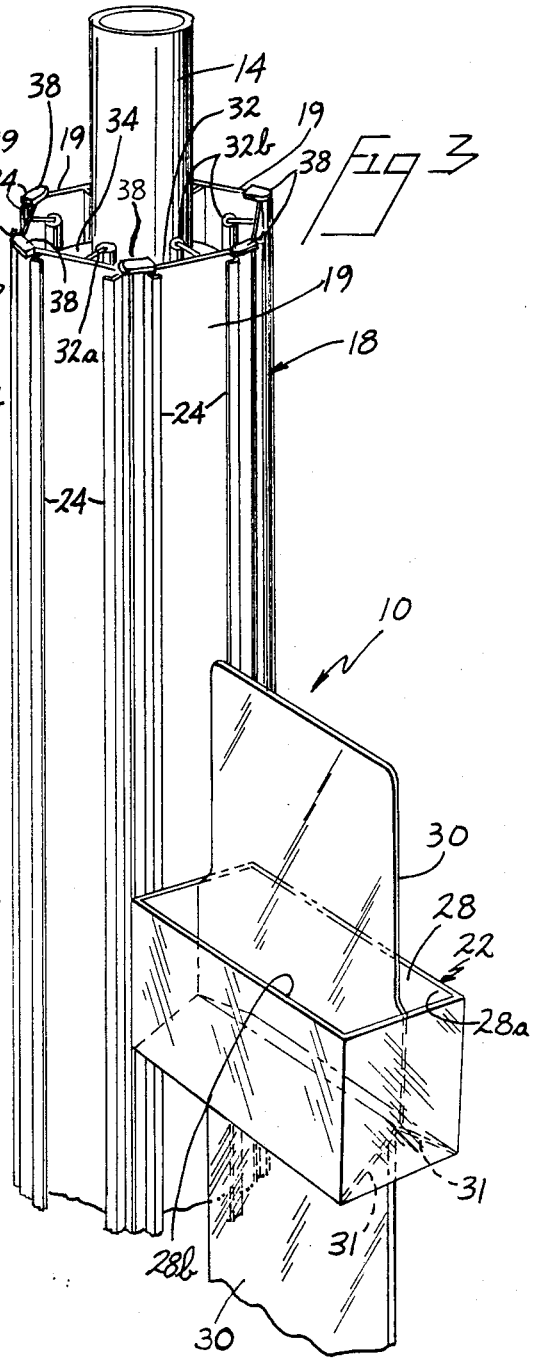
FIG. 3 is an enlarged, fragmentary, perspective view of the upper end portion of the display unit of FIGS. 1 and 2 (with the header of the display unit deleted), illustrating the hinged arrangement of support column disposed around a central support, and the preferably removable relationship of the merchandise receiving trays as mounted on tracks on the rotatable support column.

The bottom wall of receptacle 28 preferably slopes downwardly and outwardly as at 31 from the central web 30, as best seen in FIG. 3, and thus by gravity, urges the merchandise M in the trays outwardly toward the exterior respective side wall of the receptacle 28. Such sloping bottom wall sections 31 provides a recess extending lengthwise of the receptacle, which is adapted to receive therein the central web 30 on the underlying receptacle, and thus position and stack the merchandise receiving trays relative to one another in vertically oriented, laterally spaced rows on the column, and providing the "spinner" structure illustrated in FIGS. 1 and 2. Merchandise receiving trays 22 are preferably formed of translucent or transparent material, such as for instance acrylic plastic, so that the merchandise can be generally viewed through the tray structure.

Figure 15:
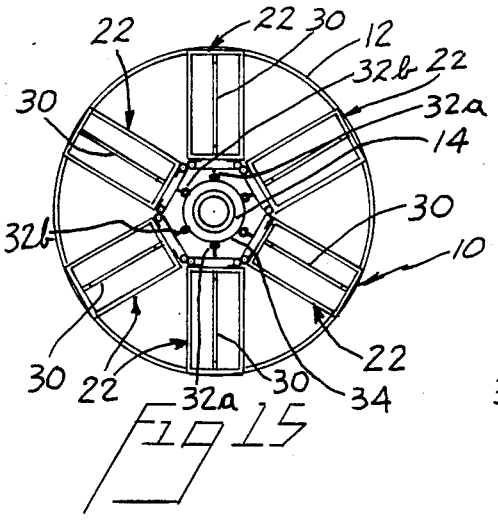
FIG. 15 is a reduced size, generally diagrammatic top plan view of the display unit illustrated in FIGS. 4 and 6.
Figure 6:
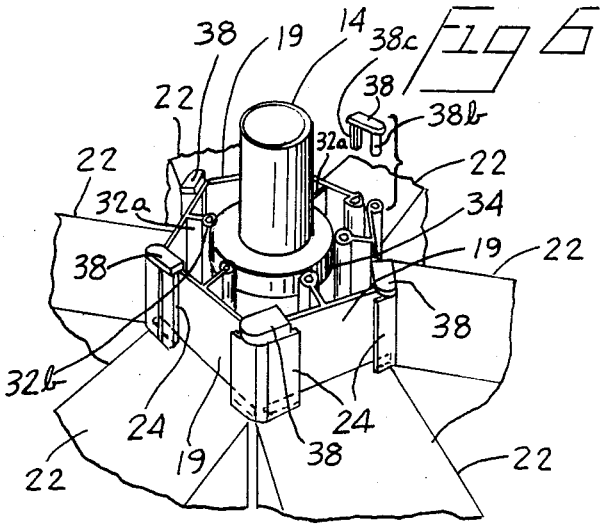
FIG. 6 is a fragmentary, generally diagrammatic top perspective view of the column and associated merchandise receiving trays mounted thereon, with the arm and cam structure of the rotatable column projecting inwardly from each inner side of the column structure and engaging a hub secured to or formed to the central support, for supporting the column structure and associated merchandise receiving trays, on the central support, for rotation with respect thereto; one of the hinge bracket members which hinges the sides of the column together, is illustrated in exploded condition from its respective adjacent sides of the column.

Each of the column side members 19 in the embodiment illustrated, comprises a generally vertically extending elongated web portion 32 and an arm portion 32*a* extending inwardly from the web portion 32 in the direction of the central support 14, with a circular (in the embodiment illustrated) cam 32*b* being provided on the distal end of arm 32*a*, adapted for engagement with a collar 34 (FIGS. 6 and 15) which is mounted on and preferably secured to the central support 14.

Cammed arms 32*a* engage the collar for supporting or mounting the column 18 on the central support 14, with the column being rotatably movable relative to the collar 34, during rotation of the column 18 on central support 14.

Figure 8:
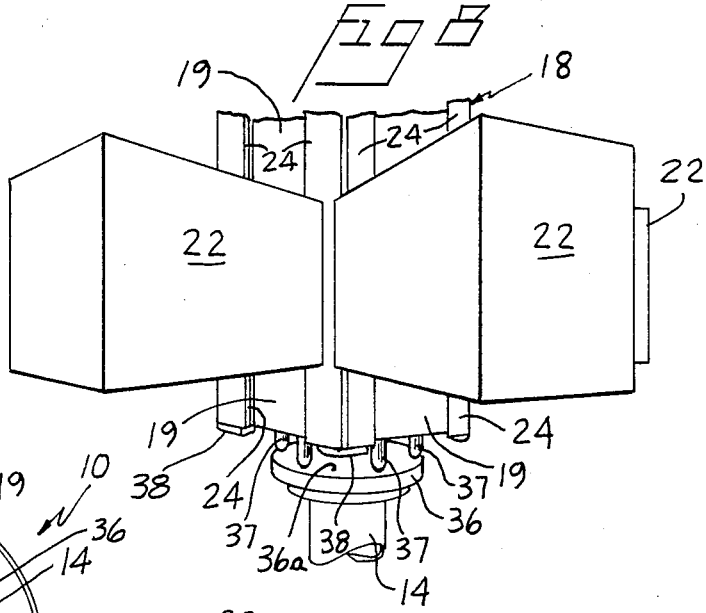
FIG. 8 is a fragmentary, elevational, perspective view of the display unit, illustrating the glide structure of FIG. 7, taken from a different view thereof, to show the supporting relationship of such structure on the column and with respect to a lower hub of the central support.
Figure 16:
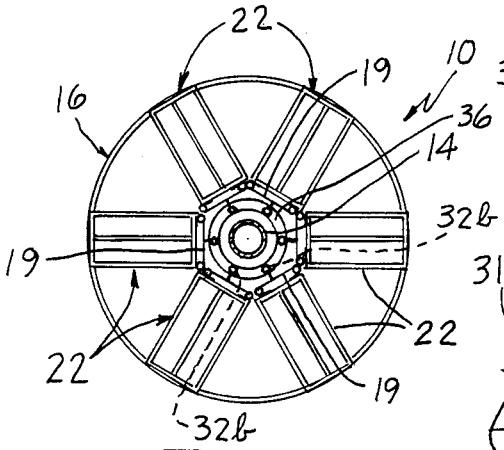
FIG. 16 is a reduced size, generally diagrammatic bottom view of the display unit taken generally along the plane of line 16—16 of FIG. 7, looking in the direction of the arrows.
Figure 7:
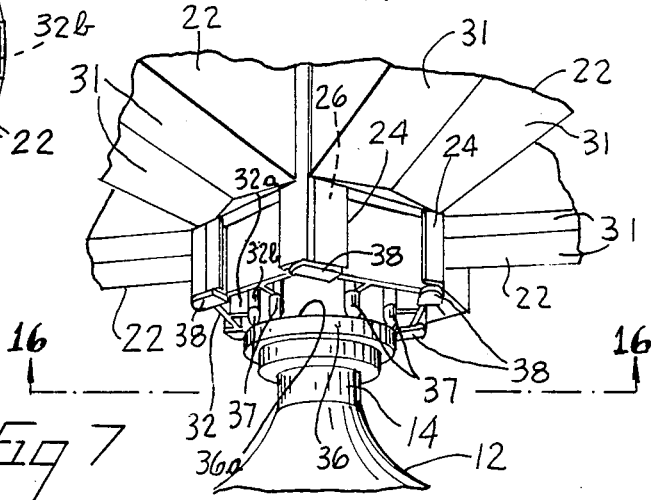
FIG. 7 is a fragmentary, perspective, bottom view of the column and associated merchandise receiving trays as mounted on the central support, and showing the engagement of the lower cams or glides of the column with the lower hub of the central support, for rotatable mounting of the column and associated merchandise receiving trays, on the central support; the trays are illustrated in a raised condition, from their normal positions, in the interests of clarity of illustration of the lower cam or glide structure.

The lower end of the central support 14 generally adjacent base 12 may also include a collar structure 36 (FIGS. 7 and 8) preferably secured to support 14, and which collar provides a generally horizontal surface 36*a*, which provide a support for glides or cams 37 attached to the underside of the respective arm 32*a* of each side of the column 18, with such glides 37 engaging surface 36*a* and aiding in supporting the hinged column 18 and associated merchandise trays 22 on the central support 14, in movable relation thereto. Glides 37 may be and preferably are formed of some low resistance material, such as for instance, nylon plastic, for ease of movement with respect to surface 36*a*, upon rotation of the column and associated merchandise receiving trays about the central support.

Referring now in particular to FIGS. 9 through 14, there is shown in detail the hinge bracket members 38, used to hinge one side member 19 to the adjacent member 19, to form the hinged column structure 18.

Hinge bracket member 38 comprises, in the embodiment illustrated, a generally horizontally oriented base portion 38*a* with a generally circular in transverse cross section, male projection 38*b* extending from the base portion 38*a* in generally perpendicular relationship with respect thereto, and with a plurality of generally deformable or yieldable finger portions 38*c* likewise projecting from the base portion 38*a*, in generally parallel relationship to the axis of the cylindrical-like male projection 38*b*. Bracket 38 is preferably formed of moldable or castable material, and as best seen in FIG. 14 is assemblable with the respective adjacent side members 19 of the column 18 and on the upper and lower ends thereof for hinging the adjacent side members together.

In this connection, each side member 19 has a circular opening or passageway 40 formed therein generally adjacent a vertical edge thereof, adapted to receive in relatively rotatable relation the aforementioned male projection 38*b* on the respective hinge bracket 38, and adjacent the other vertical edge thereof, is provided with a non-circular opening 42, which is adapted to receive therein in generally wedging relationship the deformable fingers 38*c* of an associated hinge bracket, for securing the bracket 38 in the associated opening 42, and thus hinging the pair of adjacent side members 19 of the column together In this connection, it will be seen that the opening 42 is non-circular in plan, generally D configuration in plan in the embodiment illustrated (FIG. 9) including a generally flat defining surface 42*a* and a generally curved defining surface 42*b*, and that the finger structure 38*c* likewise represents a generally D-like configuration, in plan, substantially complementary to opening 42 for wedging relation therein. Transverse structure 38*c*′ of finger 38*c* is adapted for generally flat surface-to-surface engagement with complementary surface 42*a* of opening 42 while the other radially extended finger sections of finger structure 38*c* project outwardly from the transverse portion and in the general direction of the cylindrical pivot portion 38*b* of the hinge bracket 38, thus securing the hinge bracket to its respective mounting side member 19 and yet providing for pivotal movement of the adjacent side member relative to the respective side member (via the receipt of the cylindrical male portion 38*b* within the opening 40 in such adjacent side member 19 and as shown in FIG. 14.

Figures 9, 10, 11, 12, 13, 14:
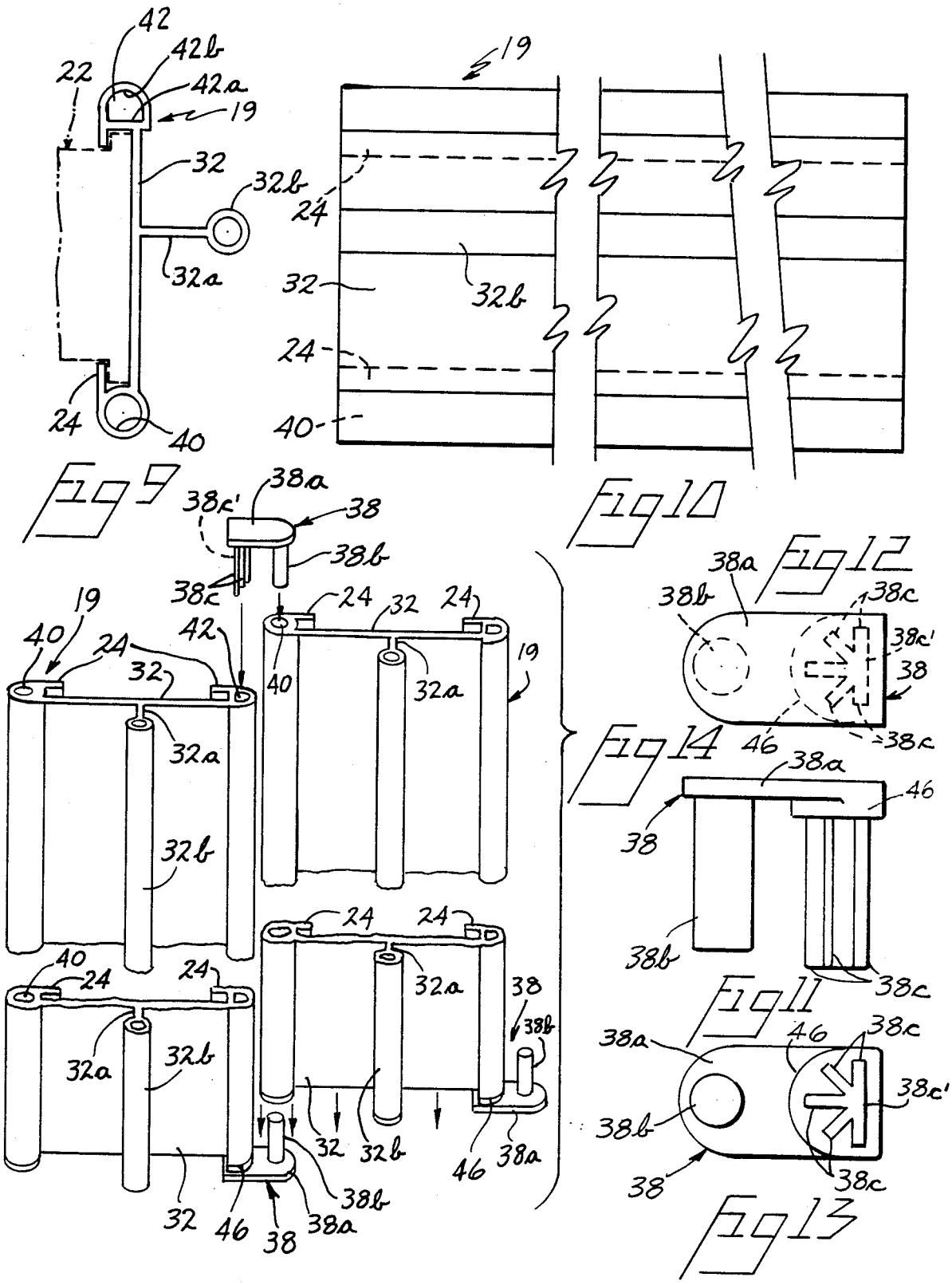
FIG. 9 is an enlarged top plan illustration of one of the side members of the column that when hinged together form the articulated column.
FIG. 10 is a broken, side elevational view of the column side member shown in FIG. 9, taken from the righthand side thereof.
FIGURE 11 is an enlarged, side elevational view of one of the coupling hinge elements for hinging the column sides together into an articulated polygonal shaped configuration.
FIG. 12 is a top plan view of the coupling hinge element of FIG. 11.
FIG. 13 is a bottom plan view of the coupling hinge element of FIG. 11.
FIG. 14 is an exploded broken view of a pair of adjacent side members of the column, showing the assembly of the coupling hinge element of FIGS. 11 through 13 with the column side members, to hinge the column side members together.

As can be best seen in FIGS. 11–13, the bracket 38 may be provided with a hub portion 46 on its underside, from which the finger structure 38*c* projects, and which causes commencement of the projection of the fingers at a lower elevation (as viewed in FIG. 11) as compared to the commencement of projection of the cylindrical male portion 38*b*, thus insuring that the pivotal or hinged side 19 is not engaged tightly between the base portions 38*a* of the respective pair of upper and lower brackets pivoting the adjacent side member 19 to the respective side member, when the cylindrical male portions 38*b* of the upper and lower hinge brackets are received in the respective receiving opening 40 therein, thus maintaining a non-binding hinged relationship between the pair of adjacent hinged side members 19.

Figure 4:
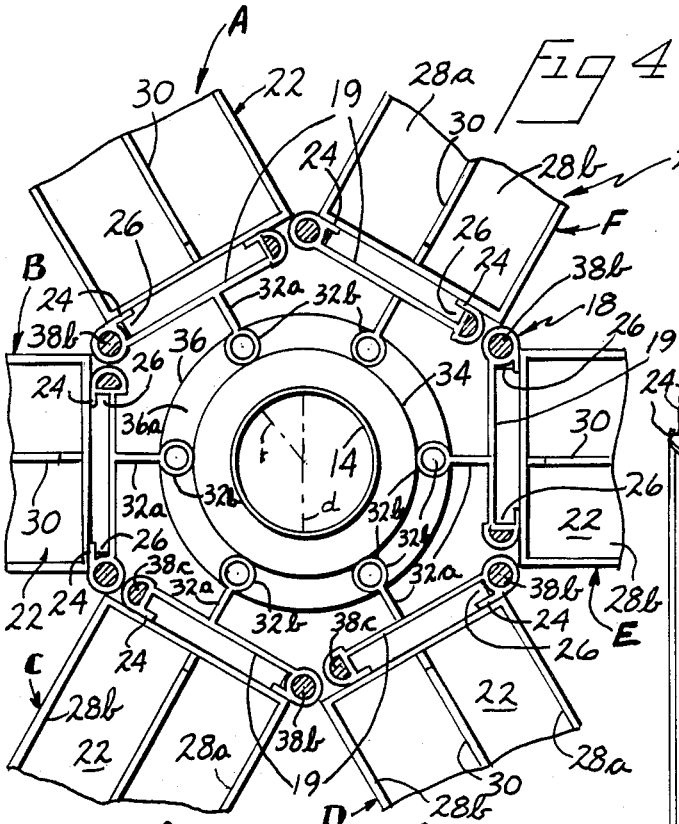
FIG. 4 is a fragmentary, enlarged top plan illustration, showing the polygonal configuration of the rotatable articulated column structure, and the outwardly projecting relationship of the merchandise receiving trays with respect to such column structure; the coupling elements hinging the sides of the column structure together, having been sectioned.
Figure 5:
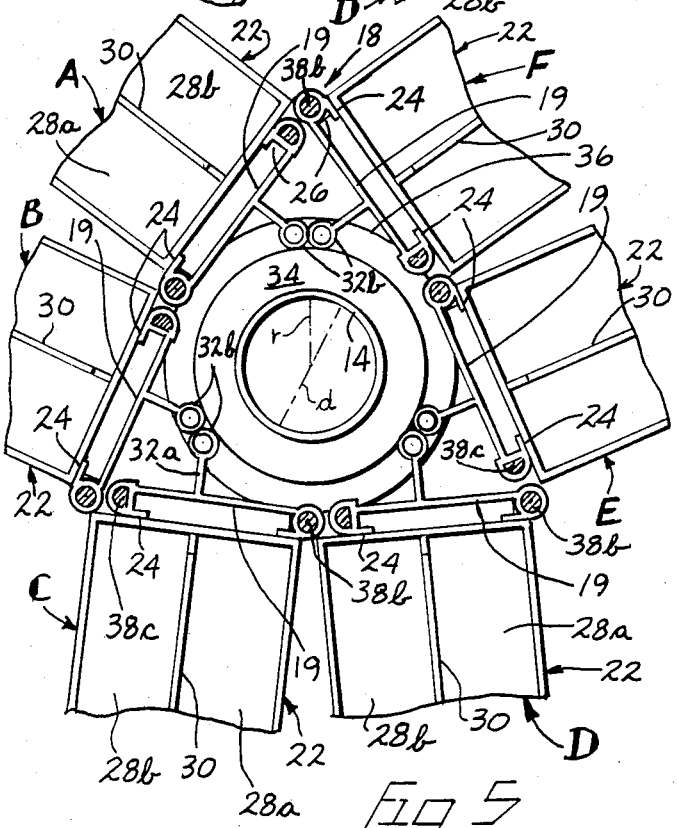
FIG. 5 is a view similar to FIG. 4, but showing the positional relationship of the hinged sides of the column structure with respect to one another after the side walls of the column and the associated receiving trays have moved in undulating or pivotal fashion with respect to one another and to a different position, and as the result of the turning or rotation of the articulated column and associated trays on the central support of the display unit.

Referring to FIGS. 4 and 5, it will be understood that applying a counterclockwise force to right hand side of tray A (as illustrated in FIG. 4) causes tray A to rotate counterclockwise around the center of its cam 32*b* as a pivot point. During this movement, the cam remains essentially on the same radius r of center support 14.

Simultaneously, tray B moves along an arcuate path generating a compound motion, one component of which moves the tray inwardly toward support 14 while another component moves the tray counterclockwise around a vertical axis through the center of support 14. Throughout its travel along the described arcuate path, the tray is retained in an essentially rectilinear relationship with diameter d through the center of support 14. Thus, the inner and outer ends of the tray remain parallel to diameter d and its sides remain perpendicular to diameter d (compare FIGS. 4 and 5).

In the course of this arcuate movement of tray B, its associated cam 32*b* slides downwardly (with reference to FIGS. 4 and 5) along the peripheral surface of collar 34, and in the direction of cam 32*b* associated with tray C.

Trays C and E undergo the identical motion described above for tray A; and trays D and F undergo the identical motion described above for tray B.

FIG. 5 shows the configuration of the trays at the far reach of the above-described motion. Contact between pairs of cam 32*b* brings the motion program to an end.

Once the stage depicted in FIG. 5 is reached, the application of additional force to the right hand side of tray A will cause all six trays to move in tandem, in a circular path around a vertical axis through the center of support 14.

Returning to FIG. 4, if a clockwise force is applied to the left hand side of tray A, the abovedescribed motion program will be conducted in reverse. Tray A will rotate clockwise around its cam 32*b* as a pivot point. Tray F will move along an arcuate path while essentially maintaining its rectilinearity with respect to a fixed diameter through the center of support 14. However, instead of cam 32*b* associated with trays A and F being in contact at the far reach of the motion (see FIG. 5) tray A's cam 32*b* will be in contact with cam 32*b* associated with tray B, and tray F's cam 32*b* will be in contact with cam 32*b* associated with tray E.

The FIG. 5 configuration can be returned to the FIG. 4 configuration by either (a) applying a clockwise force to the side of tray C closer to tray D, or the side of tray A closer to tray B, or the side of E closer to tray D; or (b) applying a counterclockwise force to the side of tray D closer to tray C, or the side of tray B closer to tray A, or the side of tray F closer to tray E.

Operation of the merchandise display unit may be as follows: When a purchaser wants to view further of the merchandise disposed in the trays 22, he will turn the unit by pushing or applying rotative force to the outwardly projecting trays, causing rotation of the column 18 and attached merchandise trays about the central support 14. If the hinged column and associated tray structure are in the position shown in FIG. 4, wherein the column 18 (in plan) defines a generally hexagonal configuration, application of rotary force to the trays and associated column by the customer will cause turning of the column and assorted trays on the central support 14, will cause the side members 19 forming the column 18 to pivot or move with respect to one another and to a position illustrated in FIG. 5, wherein the column 18 defines, in plan, a generally triangular shape configuration. During such hinged movement, the side members 19 will pivot or move relative to one another about the male projecting portions 38*b*, and the cam portions 32*b* disposed on the inwardly projecting arms 32*a* of each side member 19 forming the column structure 18, will move relative to the collar 34 into the position illustrated, for instance, in FIG. 5 wherein the cam portions 32*b* have moved into generally abutting engagement with respect to one another.

If the customer again applies a rotative force to the outwardly projecting trays and hinged column structure, the hinged column side member structure 19 and associated trays will move again relative to one another, to, for instance, back to the position shown, for instance, in FIG. 4 or some other intermediate position. It will be seen therefore, that the column side members and associated vertical rows of merchandise display trays 22 undulate or pivot with respect to one another during application of rotative force to the column and tray structure by the customer, the latter causing rotary movement of the column and associated merchandise display trays about the central support 14.

This novel undulating movement of the hinged sides of the column and associated merchandise display trays, relative to one another, provides a unique appearance to the display unit as it is rotated about the central support, as well as providing for excellent observation of the merchandise disposed in the merchandise display trays.

From the foregoing description and accompanying drawings it will be seen that the invention provides a novel rotatable, merchandise display unit comprising a generally vertical central support, supporting a vertically elongated column-like structure thereon and in rotatable relation therewith, with the column being formed of hinged side members and having a plurality of generally vertical rows of merchandise receiving trays disposed along the plural sides of the column in laterally spaced relation with respect to one another, with each of the rows of trays providing pockets or receptacles for receiving therein merchandise for display, and with the display unit being so constructed and arranged that the merchandise receiving tray structure and side members forming the associated supporting column structure undulate or pivot with respect to one another during rotation of the column structure and associated tray structure about the central support.

The invention also provides a merchandise display unit of the aforementioned type wherein the rows of merchandise receiving tray members are comprised of tray members disposed in generally stacked relationship, which are removably coupled to the hinged column.

The invention also provides a rotatable merchandise display unit of the aforementioned type wherein the tray structure is removably coupled to the hinged column structure by means of coacting wing and track structure.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

What is claimed is:

1. In a merchandise display unit comprising a generally vertical central support, an elongated column rotatably mounted on said support, said column being of generally polygonal configuration in plan and including sides hinged to one another for relative pivotal movement, and merchandise receiving trays extending outwardly from said column sides, said column sides and trays adapted to undulate upon rotation of said column and trays relative to said central support.

2. A display unit in accordance with claim 1 wherein said column sides includes a vertically elongated web member defining a respective side of said column with such web member having an arm projecting inwardly from the inner side surface thereof and having a cam portion on the distal end of each said arm, said cam portion being adapted to engage with said central support and position said column on said central support.

3. A display unit in accordance with claim 2 wherein said central support includes a collar thereon at the engagement of each said cam portion therewith, for supporting the sides of said column in said mounted relation on said central support.

4. A display unit in accordance with claim 1 wherein said column includes six sides hinged to one another.

5. A display unit in accordance with claim 1 wherein said column is so constructed and arranged that it changes from a hexagonal configuration in plan to a generally triangular configuration in plan and vice versa during said undulating movement of said sides and trays relative to said support.

6. A display unit in accordance with claim 1 including means on at least certain of said sides for detachably connecting respective of said trays thereto.

7. A display unit in accordance with claim 6 wherein said means comprises wings on each said tray adapted to be received in coacting relation with tracks in the respective of said sides of said column.

8. A display unit in accordance with claim 1 wherein each said tray comprises an enclosure having a generally vertical central web dividing the enclosure into lateral sections and with the bottom wall of each said section sloping diagonally downwardly in an outward direction from said web whereby the merchandise disposed in the respective tray will be urged by gravity laterally toward the exterior side of the respective section.

9. A display unit in accordance with claim 2 wherein said arm includes a downwardly projecting cam adapted for riding engagement with a radial shelf on said central support, for supporting the respective side of said column on the central support, and during rotation of said column and said trays relative to said central support and said radial shelf.

10. A display unit in accordance with claim 1 wherein each said side along one transverse extremity thereof includes a non-circular opening extending generally vertically therethrough, and a generally circular opening extending generally vertically therethrough at the other transverse extremity thereof, and a hinge bracket having a generally circular in cross section male portion adjacent one end thereof adapted to be received in said circular opening of the adjacent said side and said bracket also comprising a non-circular in cross section male portion adapted to be received in said non-circular opening in the respective said side, or vice versa, whereby pivotal movement of said adjacent side with the circular section opening therein can occur relative to said respective side and mounted hinge bracket, thus providing said hinged relation of said sides relative to one another.

11. A display unit in accordance with claim 10 wherein said hinge bracket comprises a generally horizontally oriented base, said circular in cross section male portion projecting downwardly from adjacent one end of said base, and a plurality of generally deformable fingers projecting downwardly from said bracket adjacent the other end of said base and comprising said non-circular in cross section male portion, and wherein said fingers are force fitted into the non-circular opening in said respective side of the column to non-movably position said bracket with respect to said respective side.

12. A display unit in accordance with claim 11 wherein said base is provided with a hub on its underside with the said fingers depending from said hub, which causes commencement of said fingers from said base at a lower elevation as compared to the commencement of said circular in cross section male portion, from said base.

13. A display unit in accordance with claim 11 wherein said transverse extremity opening in said respective side is of generally D configuration in top plan, and wherein said fingers include members thereof which project generally radially outward from a transverse finger portion in the general direction of said circular in cross section male portion of said bracket, said fingers thus defining in plan a generally D configuration generally complementary to said D configuration of said transverse extremity opening in said respective side.

14. A display unit in accordance with claim 8 wherein said central web projects upwardly above said lateral sections and is received in the bottom recess of the overlying tray to orient said trays with respect to one another in a vertical direction, said bottom recess in the overlying tray being defined by said sloping bottom walls of said lateral sections of said overlying tray.

* * * * *